US010183898B2

(12) United States Patent
Smith

(10) Patent No.: US 10,183,898 B2
(45) Date of Patent: Jan. 22, 2019

(54) EXPLOSIVE INITIATED BY LOW-VELOCITY IMPACT

(71) Applicant: Commonwealth Supplies Ltd., Burnaby (CA)

(72) Inventor: Matthew Smith, Barkeley Springs, WV (US)

(73) Assignee: Commonwealth Supplies Ltd., Burnaby (CA)

( * ) Notice: Subject to any disclaimer, the term of this patent is extended or adjusted under 35 U.S.C. 154(b) by 256 days.

(21) Appl. No.: 15/008,430

(22) Filed: Jan. 27, 2016

(65) Prior Publication Data

US 2017/0210678 A1 Jul. 27, 2017

(51) Int. Cl.

| | |
|---|---|
| ***C06B 31/28*** | (2006.01) |
| ***C06B 47/00*** | (2006.01) |
| ***F41J 5/26*** | (2006.01) |
| *C06B 31/00* | (2006.01) |
| *D03D 23/00* | (2006.01) |
| *D03D 43/00* | (2006.01) |

(52) U.S. Cl.

CPC ..... *C06B 47/00* (2013.01); *F41J 5/26* (2013.01)

(58) Field of Classification Search

USPC ..... 149/46

See application file for complete search history.

(56) References Cited

U.S. PATENT DOCUMENTS 7,632,365 B1 * 12/2009 D'Arche ..... C06B 33/12 149/37

RE45,440 E * 3/2015 Tanner ..... F41J 5/26 149/109.6

OTHER PUBLICATIONS

Basspro at https://www.basspro.com/shop/en/tannerite-exploding-rifle-targets, 2017.*

* cited by examiner

*Primary Examiner* — James E McDonough

(74) *Attorney, Agent, or Firm* — Galvin Patent Law LLC; Brian R. Galvin

(57) ABSTRACT

The use of exploding targets has become a popular practice aid in the military, law enforcement and consumer levels. The inventor has conceived and reduced to practice, in a preferred embodiment of the invention, a safe explosive target formulation that is initiated by low-velocity impact. This formulation represents a binary explosive in that the fuel and oxidizer are packaged separately until directly prior to use. Safe, explosive targets for high velocity applications are common. A formulation for low velocity projectile applications which employs an aluminum/magnesium alloy fuel and a potassium perchlorate/ammonium nitrate oxidizer is described.

4 Claims, 3 Drawing Sheets

300

EXPLOSIVE INITIATED BY LOW-VELOCITY IMPACT

BACKGROUND OF THE INVENTION

Field of the Invention

The disclosure relates to the field of riflery, and more specifically to a system for the chemical formulation of exploding rifle targets that are safe yet are initiated by low-velocity impact.

Discussion of the State of the Art

Riflery, the accurate and precise hitting of a target with a bullet shot from a rifle, is crucial to national defense and law enforcement, and has had a dramatic increase in interest and importance over the past decade due to the spread of terrorism throughout the world. Riflery also has been and continues to be a very popular sport, enjoyed to some extent by millions of people. Whether for vocation or for sport, rifle marksmanship is a very demanding, possibly even daunting pursuit which, when one takes into account the atmospheric conditions such as wind and atmospheric pressure, range to target corrections, and physical considerations such as consistent sighting, consistent breath control, consistent attentive focus and time of shot stress management, requires hundreds of hours of practice to acquire high proficiency. Maintaining and improving upon proficiency requires constant practice and refinement, again requiring countless hours of regular practice.

Much of this training and practice is accomplished using some type of simple, usually static, medium, typically of paper, that has a visual target on it, perhaps a dot of a specific size, surrounded by gradations to measure proficiency as well as to indicate the direction from the dot to which the shooter has missed. These targets may form a simple bulls eye shape or may be demarcated subregions of more interesting or appropriate shapes such as a game animal, a vehicle, a human silhouette (for law enforcement training), and so forth. Despite the attempts to make the necessary traditional paper targets more interesting, over the many hours required to attain and maintain high marksmanship proficiency, they show shortcomings that have been proven to greatly reduce practice session performance and overall proficiency over time. First, while most shooters will agree that the challenge of honing one's skills to (at first) hit perfect bull's eyes, and then to steadily increase one's precision beyond this generates a great deal of excitement; however, shooting at similar paper targets repeatedly usually leads to boredom and distraction, even for the most driven marksman. Over time, paper targets may become very frustrating to use. At the longer distances where targets are placed, one may not be able to tell how one is doing without the use of magnifying field glasses. Such frustration and challenges often leads to decreased interest and excitement during practice and can lead to decreased overall performance.

The use of exploding rifle targets has been observationally determined by riflery instructors to lead to better training results. It is believed that this improvement is primarily due to the anticipation of the explosion upon a well-placed projectile strike. This anticipation (and the associated excitement) has made its way to the sport riflery arena, where it has generated a large amount of enthusiasm and resulting high demand for explosive targets. There are several characteristics that a viable exploding rifle target must have.

Foremost, such targets must be safe. Ideally, the targets should only explode in response to being hit by a rifle projectile. Actual products should meet this ideal as closely as possible. Additionally, explosive target reagents need to withstand storage without degradation, which might cause failure such as spontaneous activation (explosion). As a consumer commodity, sport exploding rifle targets must meet all shipping regulations and explosive-related federal and state regulations. These storage and shipping requirements are met by using what are known in the art as binary explosive formulations. Binary explosive formulations for explosive riflery targets consist of two major solid chemical constituents, a strong oxidizer such as chlorates, perchlorates or nitrates, and a fuel, usually a metal or metal oxide such as aluminum, magnesium, titanium, copper oxide or iron oxide. These constituents allow for safe shipping, since the strong oxidizer and fuel are not explosive when physically separated and can be shipped with only an oxidizer warning. Shipping powders is also much easier. The other major concern is reagent degradation, which is mitigated through the use of special packaging by manufacturers.

Currently, the vast majority explosive targets for high velocity rifle projectiles (for example, .223, .308, 30/30 and 5.56 caliber rounds) are comprised of mixtures of finely meshed ammonium nitrate prill and aluminum powder, often with small amounts of other reagents such as zirconium, titanium, and ammonium perchlorate added, which serve to better propagate the reaction toward detonation, mixed with the main fuel/oxidizer portions of the kit. Just prior to use, the two reagent powders, fuel and oxidizer, are combined and thoroughly mixed to form the explosive product mixture. This basic aluminum/ammonium nitrate formulation is used because, even when mixed and ready for use, the targets are highly flame resistant, and do not activate if dropped, hit with a hammer, thrown, or even hit with lesser energy projectiles such as shotgun slugs or the smaller, less energetic .22 caliber rifle fire. The formulation is very safe when used as intended, even if simple accidents occur. There is, however, a significant perceived downside to the fact that targets formulated from nearly pure aluminum and ammonium nitrate will only activate when hit by a high velocity round. This requirement prevents a significant population of target rifle enthusiasts from using explosive targets (for example, those with small caliber .22LR rifles). Manufacturers have employed, with marginal safety success, several fuel and oxidizer formulations to create explosive targets for the low-velocity market. These lower energy projectile formulations involve the use of more reactive reagents, such as mixtures of potassium chlorate or potassium perchlorate oxidizers, with very fine powders of aluminum (which are slight variants of the flash powder used in early photography and present day fireworks). Other low-velocity formulations use sulfur compounds, or copper oxide containing fuels. These formulations, while allowing the use of exploding targets in low-velocity, 0.22LR riflery, require significantly more vigilance for safe use than do the binary formulations used for high-velocity riflery. Flash powder is highly sensitive to flame and static electric discharge, both of which can cause explosive activation, so participant behavior and the triboelectric characteristics of all packaging that comes into contact with the mixed target must be front of mind. Formulations may also explosively activate if dropped or thrown. Some formulations are quite sensitive to reagent degradation or atmospheric conditions which can, under some circumstances, lead to spontaneous activation leading to storage concerns.

What is needed is a binary formulation for an explosive that can be initiated by low-velocity impact and is also safe to ship, store, and use.

SUMMARY OF THE INVENTION

The inventor has conceived and reduced to practice, in a preferred embodiment of the invention, a system and method for an explosive that is safe to handle and that can be initiated by low-velocity impact.

According to a preferred embodiment of the invention, a system for an explosive that is safe to handle and that can be initiated by low-velocity impact comprising a strong chemical oxidizer, a chemical fuel for the redox reaction, a water tight, plastic package, a package that provides an oxygen barrier and a semi-rigid container with a tight fitting top has been developed. The strong chemical oxidizer:participates in a redox reaction with the fuel; is a defined mixture of fine ammonium nitrate ($NH_4NO_3$) prills and very finely meshed potassium perchlorate ($KClO_4$); may contain a small amount of desiccant to reduce caking but which does not effect the oxidation reaction; the potassium perchlorate coats the ammonium nitrate prills; the potassium perchlorate reacts with the fuel prior to the ammonium nitrate by explosive detonation and may serve to prime the reaction between the ammonium nitrate and the fuel and the ammonium nitrate reacts by explosive detonation with the fuel producing the majority of the explosive report. The chemical fuel: is a finely meshed alloy of aluminum and magnesium; reacts with the strong chemical oxidizer by detonation to create an explosion with a loud report; the magnesium component is more reactive with the oxidizer than is the aluminum component and sensitizes the fuel mixture for activation under low velocity projectile conditions. The moisture tightly sealed plastic package: is used to pack the strong chemical oxidizer for storage and shipment; and protects the hygroscopic strong chemical oxidizer from moisture. The packaging for the fuel: may be comprised of a poly oxygen barrier sandwiched between two puncture-resistant plastic sheets; is used to pack the chemical fuel for the redox reaction; and prevents oxidative degradation of the chemical fuel for the redox reaction during shipment and storage. Finally, the semi-rigid container with a tight fitting top: may serve as the container for the individually packaged components of the explosive targets during shipment and storage; may be used as the vessel in which to thoroughly mix the strong chemical oxidizer and the chemical fuel for the redox reaction just prior to use as a riflery target; is engineered not to produce potentially harmful shrapnel during the explosive reaction and, when provided, serves the ultimate explosive rifle target.

According to another preferred embodiment of the invention, a method for making and using an explosive that is safe to handle and that can be initiated by low-velocity impact has been developed. The method steps comprising: (a) create a defined alloy of aluminum and magnesium as the fuel for an explosive redox reaction and store measured amounts of finely meshed particles in oxygen barrier, air tight packaging; (b) create experimentally determined, defined mixture of fine ammonium nitrate prills and very finely meshed potassium perchlorate powder as the strong oxidizer for an explosive redox reaction and store measured amounts in moisture barrier plastic packaging; (c) store and ship both components isolated in their respective, custom, protective packaging, possibly contained in a specially designed, non-shrapnel producing, semi-rigid jar-like container; (d) mix the fuel and strong oxidizer thoroughly just prior to use as an explosive target; and, if included, (e) place the specially designed jar containing mixed explosive at a safe distance from firing line based upon size of charge and hit the explosive target directly with either a low velocity projectile or a high velocity projectile based upon the design of the particular target product in use.

BRIEF DESCRIPTION OF THE DRAWING FIGURES

The accompanying drawings illustrate multiple embodiments of the invention and, together with the description, serve to explain the principles of the invention according to the embodiments. One skilled in the art will recognize that the particular embodiments illustrated in the drawings are merely exemplary, and are not intended to limit the scope of the present invention.

DETAILED DESCRIPTION

Figure 1:
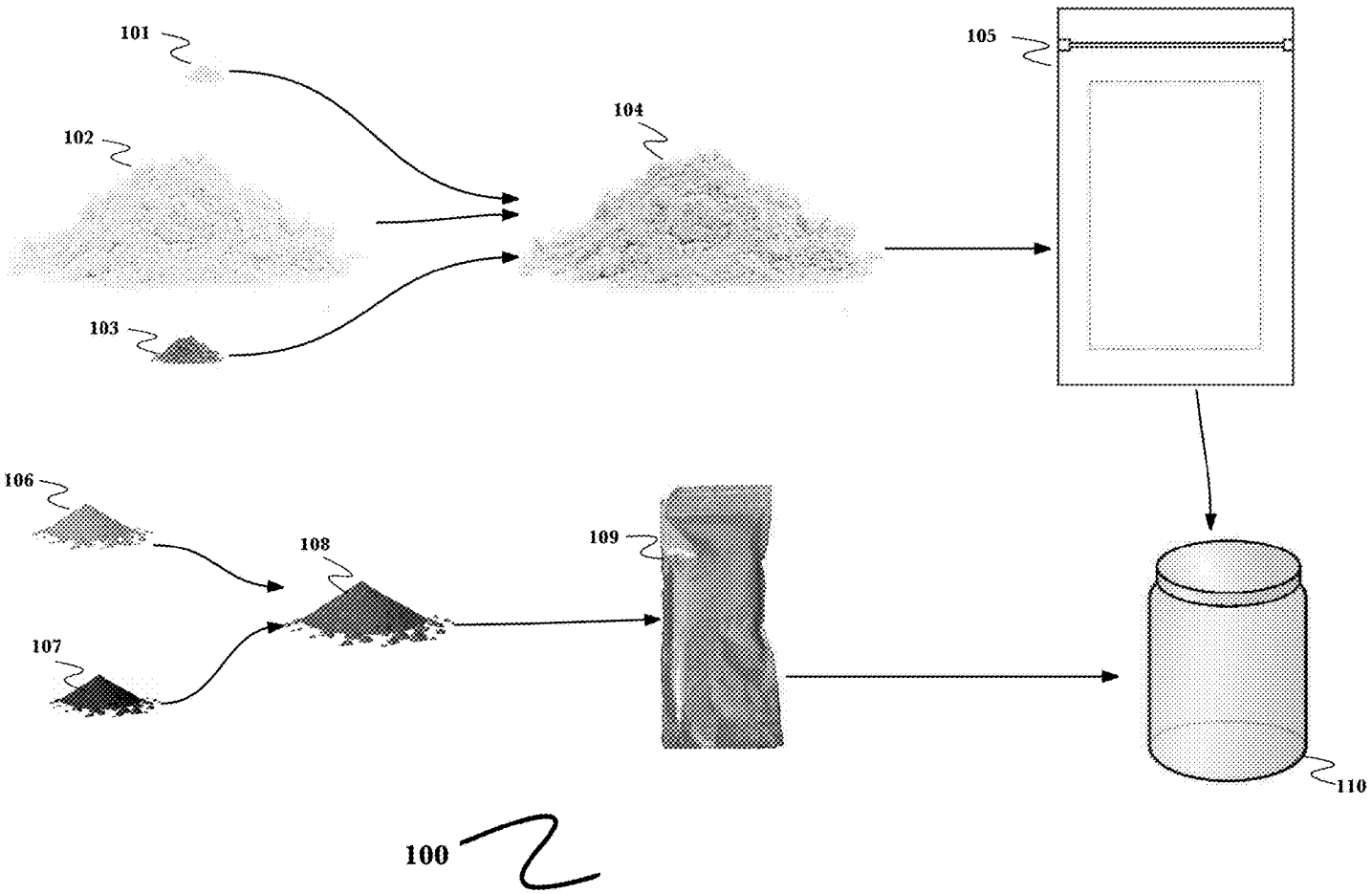
FIG. 1 shows exemplary chemical mixtures for formulation and custom packaging of the strong oxidizer and metal fuel for a low velocity projectile exploding target according to a preferred embodiment of the invention.

The inventor has conceived, and reduced to practice, a system and method for an explosive that is safe to handle and can be initiated by low velocity impact.

One or more different inventions may be described in the present application. Further, for one or more of the inventions described herein, numerous alternative embodiments may be described; it should be understood that these are presented for illustrative purposes only. The described embodiments are not intended to be limiting in any sense. One or more of the inventions may be widely applicable to numerous embodiments, as is readily apparent from the disclosure. In general, embodiments are described in sufficient detail to enable those skilled in the art to practice one or more of the inventions, and it is to be understood that other embodiments may be utilized and that structural, logical, and other changes may be made without departing from the scope of the particular inventions. Accordingly, those skilled in the art will recognize that one or more of the inventions may be practiced with various modifications and alterations. Particular features of one or more of the inventions may be described with reference to one or more particular embodiments or figures that form a part of the present disclosure, and in which are shown, by way of illustration, specific embodiments of one or more of the inventions. It should be understood, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

Headings of sections provided in this patent application and the title of this patent application are for convenience only, and are not to be taken as limiting the disclosure in any way.

Devices that are in connection with each other need not be continuously connected with each other, unless expressly specified otherwise. In addition, devices that are in connection with each other may connect directly or indirectly through one or more intermediaries, logical or physical.

A description of an embodiment with several components in connection with each other does not imply that all such components are required. To the contrary, a variety of optional components may be described to illustrate a wide variety of possible embodiments of one or more of the inventions and in order to more fully illustrate one or more aspects of the inventions. Similarly, although process steps, method steps, algorithms or the like may be described in a sequential order, such processes, methods and algorithms may generally also work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring sequentially (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred. Also, steps are generally described once per embodiment, but this does not mean they must occur once, or that they may only occur once each time a process, method, or algorithm is carried out or executed. Some steps may be omitted in some embodiments or some occurrences, or some steps may be executed more than once in a given embodiment or occurrence.

When a single device or article is described, it will be readily apparent that more than one device or article may be used in place of a single device or article. Similarly, where more than one device or article is described, it will be readily apparent that a single device or article may be used in place of the more than one device or article.

The functionality or the features of a device may be alternatively embodied by one or more other devices that are not explicitly described as having such functionality or features. Thus, other embodiments of one or more of the inventions need not include the device itself.

Techniques and mechanisms described or referenced herein will sometimes be described in singular form for clarity. However, it should be noted that particular embodiments include multiple iterations of a technique or multiple manifestations of a mechanism unless noted otherwise.

DETAILED DESCRIPTION OF EXEMPLARY EMBODIMENTS

The system and method disclosed herein, in a preferred embodiment, uses a specialized, novel formulation of a mixed strong oxidizer and an alloyed metal fuel, both of controlled powder size, which, when combined with specialized storage packaging, creates a binary explosive target reagent that can be used for both low-velocity projectile and high-velocity projectile applications but is also safe to ship, store and handle up through impact.

FIG. 1 shows exemplary chemical mixtures for formulation and custom packaging of the strong oxidizer and metal fuel for a low velocity projectile exploding target according to a preferred embodiment of the invention 100. The oxidizer used in the formulation 104 is comprised of an approximate ten to one mixture of the strong oxidizers ammonium nitrate 102 and potassium perchlorate 103 respectively. In one embodiment of the invention this would translate to 230 g of ammonium nitrate and 20 g of potassium perchlorate. While the invention should not be interpreted to depend on the mixture being exactly this ratio of ammonium nitrate 102 to potassium perchlorate 103, this ratio has been found to be optimal for safety and sensitivity to a low velocity projectile such as a 0.22LR. The inventors have determined that using as little as 3% less potassium perchlorate than the optimum or as little as 4% to 5% more ammonium nitrate in the optimum mixture 104 reduces sensitivity such that low velocity projectiles do not reliably activate detonation. Using a mixture richer in potassium perchlorate progressively increases the occurrence of inappropriate detonation to near that of flash powder levels, drastically reducing safety. In addition to the chemical constituents used in the oxidizer, the size of the powder particles of these constituents has a very large impact on reactivity. The inventors have empirically found that using moderately fine ammonium nitrate prills 102 and very finely meshed potassium perchlorate powder 103 (for example, 400 to 600 mesh) results in the most effective coating of the ammonium nitrate 102 by the potassium perchlorate 103 results in the most complete detonation while minimizing compressive caking of the mixture 104 which greatly and adversely effects detonation. The use of explosive grade reagents, which are used in the manufacture of the oxidizer mixture, has been found to produce somewhat more reliable results but the invention in no way depends on this. The oxidizer mixture is hygroscopic, which, if not mediated can lead first to caking and then to can lead to dissolution and leakage of the reagent during handling. The invention resolves this issue in two ways, first a small amount of desiccant 101 is added to the mixture during manufacture, and the mixture is then placed into moisture tight plastic packaging for shipment and storage 105.

The detonation fuel 108 used in the invention is an alloy of 50% to 60% aluminum 107 and 40% to 50% magnesium 106. While the invention is not absolutely dependent on the aluminum to magnesium ratio being exactly within this range, the inventors have empirically determined that certain ratios within this range of combinations optimize the safety of the assembled explosive target by all but preventing spontaneous activation and insure that the targets detonate reliability when struck by a low velocity projectile by producing the best timing within the very early explosive reaction when the highly reactive magnesium 108 and the ammonium nitrate 104 come into contact in reactive form. As with the oxidizer 104, reactivity is significantly affected by particle size, the aluminum/magnesium alloy 108 is therefore used as a very fine powder with a particle size of 200 to 350 mesh were found to work best. Last, spontaneous oxidation due to oxygen in the atmosphere can significantly change the reactivity of the alloy powder over time during storage, so, while the invention should not be confined by a specific type of packaging for either the oxidizer or the fuel, a special package 109 consisting of an oxygen-barrier layer sandwiched between two puncture resistant layers is used to ship and store the metal alloy fuel 108.

In many cases both the packaging containing the pre-measured oxidizer mixture 104 and the packaging containing the pre-measured reaction fuel 108 is placed into a specially-designed, non-shrapnel-producing jar-like container 110 for shipment and storage. Once on the shooting site, this container 110 may also serve as the mixing vessel to combine and thoroughly mix the oxidizer and fuel followed by use of the container as the ultimate, exploding target within the target as a whole.

Figure 2:
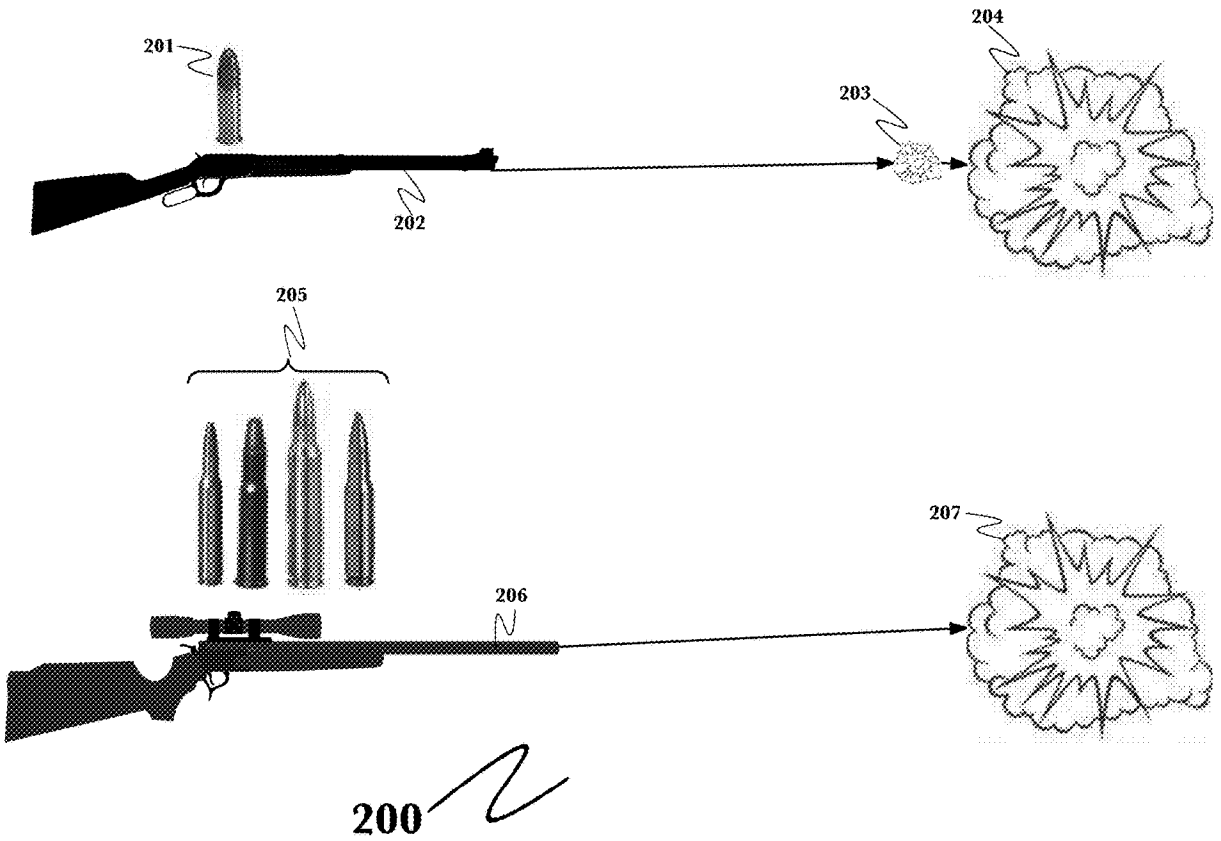
FIG. 2 shows an exemplary diagram of the role of reagent sensitization on the explosive target during low velocity projectile use according to a preferred embodiment of the invention.

FIG. 2 shows exemplary diagrams 200 of a low velocity, .22LR, projectile 201 explosive target detonation 203, 204 and a high velocity, for example, but not limited to, .223, .308, 30/30, or 5.56 mm, projectile explosive target detonation 207. When struck by a low velocity projectile the presence of the potassium perchlorate that coats the ammonium nitrate serves to sensitize the ammonium nitrate so that it reacts with the metal fuel when hit by the smaller, less energetic .22LR projectile when it normally would not do so. Presence of magnesium in the aluminum/magnesium alloy has a similar effect of reducing the concussive activation energy needed to drive detonation. While not, in reality, a separate explosive reaction, 203 represents this "primer like" effect of the presence of the magnesium and potassium perchlorate in the main low velocity projectile detonation 204 on the classic aluminum and ammonium nitrate reaction of a standard high velocity projectile exploding target detonation 207. Last, it is possible to use the invention system in a high velocity application 205, 206, 207, however, presence of the magnesium and potassium perchlorate would have no discernible effect on the standard aluminum and ammonium nitrate detonation reaction of existing explosive targets.

Figure 3:
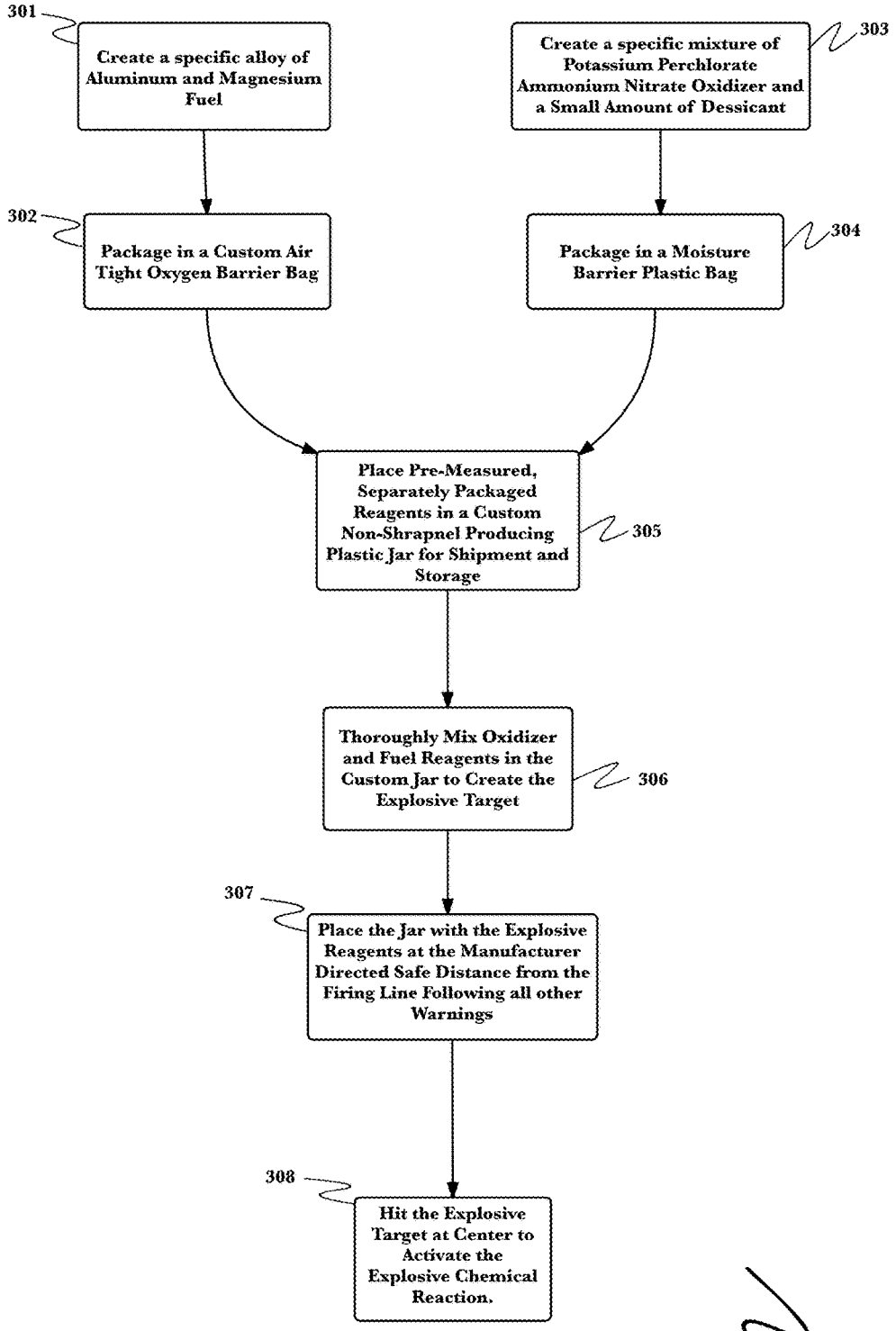
FIG. 3 is a method diagram showing exemplary steps in the creation of a safe binary explosive target that can be used for in both low velocity projectile and high velocity projectile applications according to a preferred embodiment of the invention.

FIG. 3. is a method diagram showing exemplary steps in the creation of a safe binary explosive target that can be used for in both low velocity projectile and high velocity projectile applications according to a preferred embodiment of the invention 300. In step 301, an alloy of magnesium and aluminum is created as the fuel for the binary explosive target of the invention. While not specifically required by the invention, it has been empirically determined by the inventors that a aluminum to magnesium alloy powder 108 with a very fine particle size produces optimal safety and detonation reliability in low velocity projectile applications when mixed with the oxidizer formulated in step 303, 104. Oxidation of the fine powder form of the alloy fuel 108 greatly effects the fuels reaction characteristics and the alloy fuel powder is thus packaged in a custom air tight oxygen barrier bag 109 in step 302. The oxidizer used in the binary explosive of the invention is created in step 303 and is a specifically developed mixture of ammonium nitrate to potassium perchlorate, for example 220 g of ammonium nitrate to 25 g of potassium perchlorate. As with the fuel alloy, while the inventors have empirically determined that the stated ratio of ammonium nitrate to potassium perchlorate gives rise to optimal safety during shipping, storage, reagent mixing and deployment of the explosive, small variations in this ratio should not be felt outside of the intent of the invention. The oxidizer mixture is known to be hygroscopic and moisture is a known detriment to detonation, the oxidizer the thus placed in moisture barrier packaging 105 in step 304. While the invention in no way depends on its inclusion and it may not be included in all embodiments of the explosive targets derived from the invention, the packages comprised of the fuel and oxidizer may then be placed in a specially designed non-shrapnel producing plastic jar-like container 110 in step 305. In one embodiment of the invention, the container provides added protection and containment for the fuel and oxidizer packaging. While its presence is certainly not required for the task as the oxidizer packaging or some other container can be used for the purpose, the jar-like container also serves as a convenient vessel in which to thoroughly mix the metal alloy fuel reagent 108 and oxidizer reagent 109 to create the explosive target consisting of for example, approximately 80% w ammonium nitrate, 10% w potassium perchlorate and 10% w aluminum:magnesium alloy in step 306. The jar-like container also serves as a convenient, safe, container to be placed as the ultimate target in the explosive target device at the shooting site as in step 307. In the last step 308, the invention target is directly hit by a low velocity projectile such as a .22LR resulting in detonation. One knowledgeable in the art will realize that the formulation of the invention can also be used in high velocity applications although its behavior would be similar to the formulation available for that setting.

The skilled person will be aware of a range of possible modifications of the various embodiments described above. Accordingly, the present invention is defined by the claims and their equivalents.

What is claimed is:

1. A system for an explosive target that is initiated by low-velocity impact, the system comprising:

a strong chemical oxidizer;

a chemical fuel for the redox reaction;

a water tight, plastic package;

a package for the fuel that provides an oxygen barrier; and a semi-rigid container with a tight fitting top;

wherein, the strong chemical oxidizer:

(a) participates in a redox reaction with the fuel;

(b) is a defined mixture of ammonium nitrate ($NH_4NO_3$) prills and meshed potassium perchlorate ($KClO_4$) sized at 400 to 600 mesh, wherein the potassium perchlorate coats the ammonium nitrate prills;

(c) may contain a small amount of desiccant to reduce caking but which does not effect the oxidation reaction;

(d) the potassium perchlorate reacts with the fuel prior to the ammonium nitrate by explosive detonation and may serve to prime the reaction between the ammonium nitrate and the fuel; and (e) the ammonium nitrate reacts by explosive detonation with the fuel producing the majority of the explosive report;

wherein; the chemical fuel:

(f) is an alloy of aluminum and magnesium in the form of pellets sized at 200 to 350 mesh;

(g) reacts with the strong chemical oxidizer by detonation to create an explosion with a loud report; and (h) the magnesium component is more reactive with the oxidizer than is the aluminum component and serves to sensitize the formulation for detonation under low velocity projectile conditions;

wherein, the water tight sealed plastic package:

(i) is used to pack the strong chemical oxidizer for storage and shipment; and (j) protects the hygroscopic strong chemical oxidizer from moisture;

wherein, the package that provides an oxygen barrier:

(k) may be comprised of a poly oxygen barrier sandwiched between two puncture resistant plastic sheets;

(l) is used to pack the chemical fuel for the redox reaction; and (m) prevents oxidative degradation of the chemical fuel for the redox reaction during shipment and storage;

wherein, the semi-rigid container with a tight fitting top:

(n) may serve as the container for the individually packaged components of the explosive targets during shipment and storage;

(o) may be used as the vessel in which to thoroughly mix the strong chemical oxidizer and the chemical fuel for the redox reaction proximal to use as a target;

(p) is engineered not to produce potentially harmful shrapnel during the explosive reaction (q) may serve as the ultimate explosive target.

2. The system of claim 1 where enclosure of the strong chemical oxidizer mixture and the chemical fuel for the redox reaction in separate plastic packaging prevents classification as an explosive and allows safe shipment and long term storage.

3. The system of claim 1 where the increased reactivity of the magnesium in the aluminum: magnesium alloy of the chemical fuel for the redox reaction and the small amount of potassium perchlorate in the strong chemical oxidizer makes the combined, explosive mixture sensitive enough to activate upon a direct hit by a low velocity projectile while maintaining a very high level of resistance to spontaneous activation and a safe level of resistance to activation by lesser impacts.

4. The system of claim 3 where the formulation is extremely resistant to activation due to triboelectric effect and thus does not rely on use of anti-static materials or procedures.

* * * * *